United States Patent [19]

Sommer

[11] Patent Number: 4,493,613

[45] Date of Patent: Jan. 15, 1985

[54] OIL WELL PUMP DRIVE

[75] Inventor: Gordon M. Sommer, Boca Raton, Fla.

[73] Assignee: Petroleum Recovery Systems, Inc., Warren, Mich.

[21] Appl. No.: 567,006

[22] Filed: Dec. 30, 1983

Related U.S. Application Data

[63] Continuation-in-part of Ser. No. 327,718, Dec. 4, 1981, abandoned.

[51] Int. Cl.[3] ..... F04B 49/00

[52] U.S. Cl. ..... 417/15; 192/18 A; 192/51; 192/48.9; 192/87.14; 417/45; 417/223; 417/319

[58] Field of Search ..... 417/223, 319, 362, 15, 417/44, 45; 192/21, 51, 18 A, 48.9, 48.1, 48.8, 87.14; 74/335, 404

[56] References Cited

U.S. PATENT DOCUMENTS

| | | | |
|---|---|---|---|
| 2,582,564 | 1/1952 | Schneck et al. | 60/372 |
| 3,550,735 | 12/1970 | Olsen | 192/51 X |
| 3,696,898 | 10/1972 | Sommer | 192/18 A |
| 3,741,360 | 6/1973 | Patton | 192/51 X |
| 3,807,902 | 4/1974 | Grable et al. | 417/46 |
| 4,145,161 | 3/1979 | Skinner | 417/45 X |

*Primary Examiner*—Edward K. Look

*Attorney, Agent, or Firm*—Harness, Dickey & Pierce

[57] ABSTRACT

An oil pump assembly having an adjustable production rate and capable of long stroke, low stroke per minute pumping rates, comprising a reciprocating pumping rod in a well hole, a counterbalancing mechanism for reducing the power needed to pump oil by the pumping rod, a driving mechanism to drive the reciprocating pumping rod and the counterbalancing mechanism, including a first cable and a second cable, to drive the reciprocating pumping rod and the counterbalancing mechanism, respectively, a speed control for the driving mechanism, and a dwell mechanism for the driving mechanism.

12 Claims, 5 Drawing Figures

OIL WELL PUMP DRIVE

CROSS-REFERENCE TO RELATED APPLICATION

This application is a continuation-in-part of U.S. Ser. No. 327,718, filed Dec. 4, 1981, now abandoned.

BACKGROUND AND SUMMARY OF THE INVENTION

The present invention relates generally to the pumping of wells such as oil wells, and in particular to an oil well pump assembly having an adjustable production rate capable of long stroke, low stroke per minute pumping rates.

Prior art oil wells have been pumped for many years with a walking beam pump having a relatively large crank and arm assembly providing a sharp acceleration and deceleration of a pump rod. The walking beam arrangement needed a number of reversals per minute of the pump along with a short stroke pumping rod to provide sufficient production. With a walking beam pump, the pumping rod had to be larger than desired since the end of the rod never catches up with the pump in the pumping process and the effective stroke of the rod due to the elasticity of the rod was always less than the actual length of the rod. Also, the crank had to be physically changed in order to change the production rate of the pump.

Improvements were made to the walking beam pumping arrangement by those systems described in U.S. Pat. Nos. 3,744,567, 3,793,904, and 3,807,902, where long stroke pumping assemblies were devised which had counterbalanced weights reciprocally attached to the well pump to move the pumping mechanism and aid the pumping mechanism by the force of gravity on its return stroke. Several disadvantages have presented themselves with the use of the prior art reciprocal well pumps as disclosed in the above referenced patents. First, each of the pumps uses a direct current motor on a spiral (a varying diameter spool) with a hydrostatic drive. The hydrostatic drive does not have a great deal of longetivity and requires a complex set of controls in order to operate the unit. The device as represented by the referenced prior art patents also only controls the speed of the unit. Furthermore, side loads are imposed on the sucker rods of the above-referenced patents.

The present invention has the object of using an oil shear clutch mechanism and brake mechanism to control the operation of a counterbalanced well pump. Such an arrangement permits an alteration in the speed of the unit and also in the dwell time of a unit at the top and the bottom of each stroke, to allow the rod to catch up with the unit and have an effective stroke of the length of the rod. Furthermore, the present invention has an object of eliminating side loads imposed by the sucker rods to extend the life of the unit.

Each of the above advantages is also meant to be included with a pump assembly that has an adjustable production rate readily adjustable externally of the pump assembly. The production rate can be monitored by a main computer by monitoring the sampling and the motor amperage to consistently provide an optimum condition in the performance of the pump. This same computer may be monitoring a number of the pump assemblies of the present invention.

The prior art units also had an energy disadvantage due to the rough accelleration of the unit taking power away from the operation of the unit. The present invention has an energy advantage over the prior art due to the provision of a controlled ramp for accelleration and deceleration of the pump assembly.

The present invention also has the object of providing a pump assembly which is potentially ecologically aesthetic for areas that find objection to large observable well pumps. The present invention may be constructed to have an effective physical size of 5 to 7 feet above ground level, which, in a commercial or residential setting, could locate the unit underneath the parking lot, surrounded by a fence or hedge, within a small attractive housing structure, or in another ecologically aesthetic surrounding. Such a use would also permit the surface real estate to be utilized for something else other than a mere well pumping station. A small pump assembly may also be more amenable to protection against vandalism and the pumps may be situated more closely together, as a series of directional wells to obtain a higher density than prior art well pumps. The present invention also has a much lower weight than the prior art units, which may provide an advantage particularly for off-shore wells where a number of the pumps may have to be attached to a vehicle rig.

Essentially, the present invention provides a simplified, more compact, and potentially more ecologically appealing unit than the prior art.

Additional objects and advantages of the invention, as well as the details of an illustrative embodiment, be more fully understood from the following description and drawings.

DETAILED DESCRIPTION OF THE PREFERRED EMBODIMENTS

Figure 1:
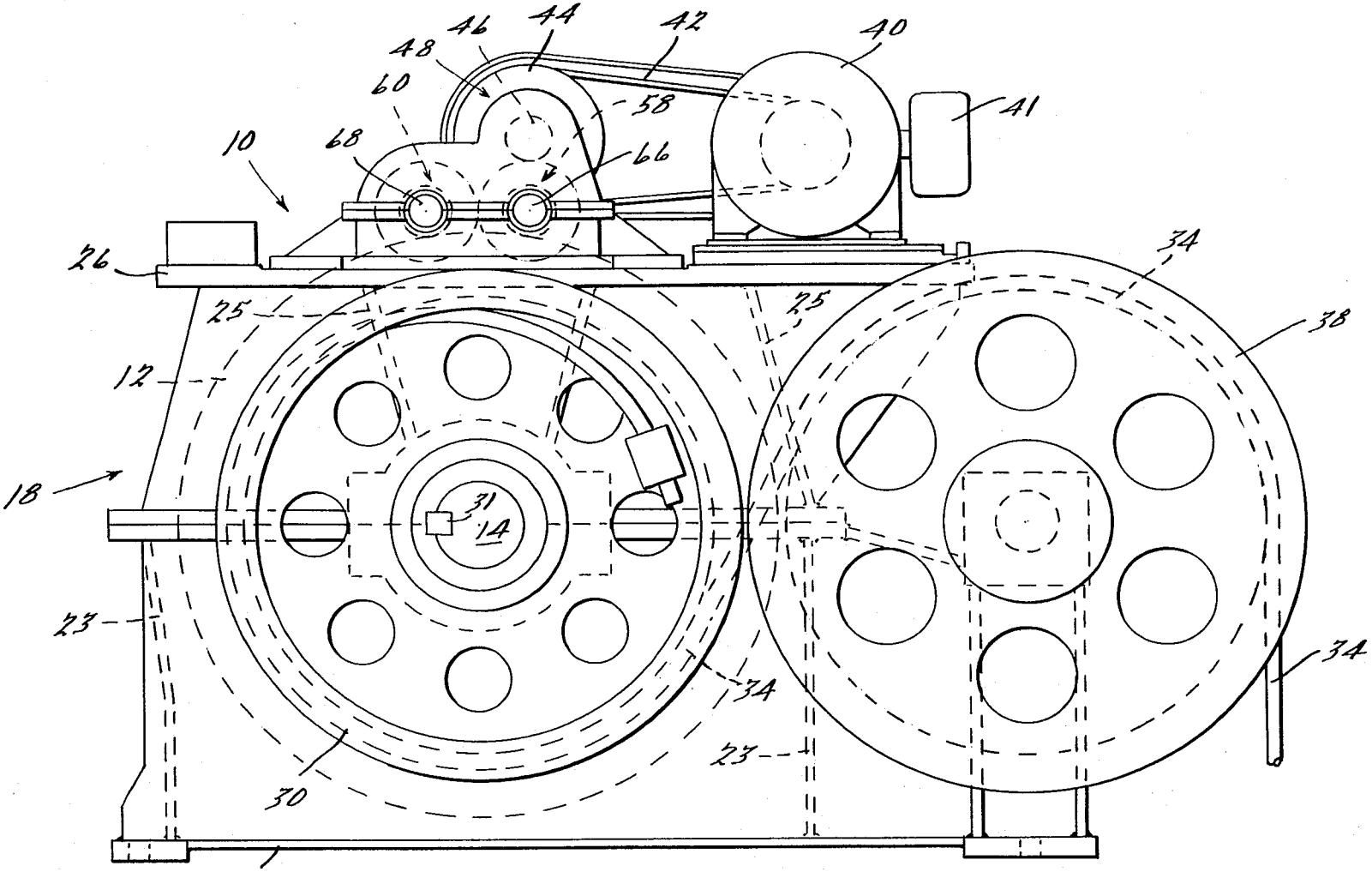
FIG. 1 is a side elevational view of the counterbalanced pump of the present invention.
Figure 2:
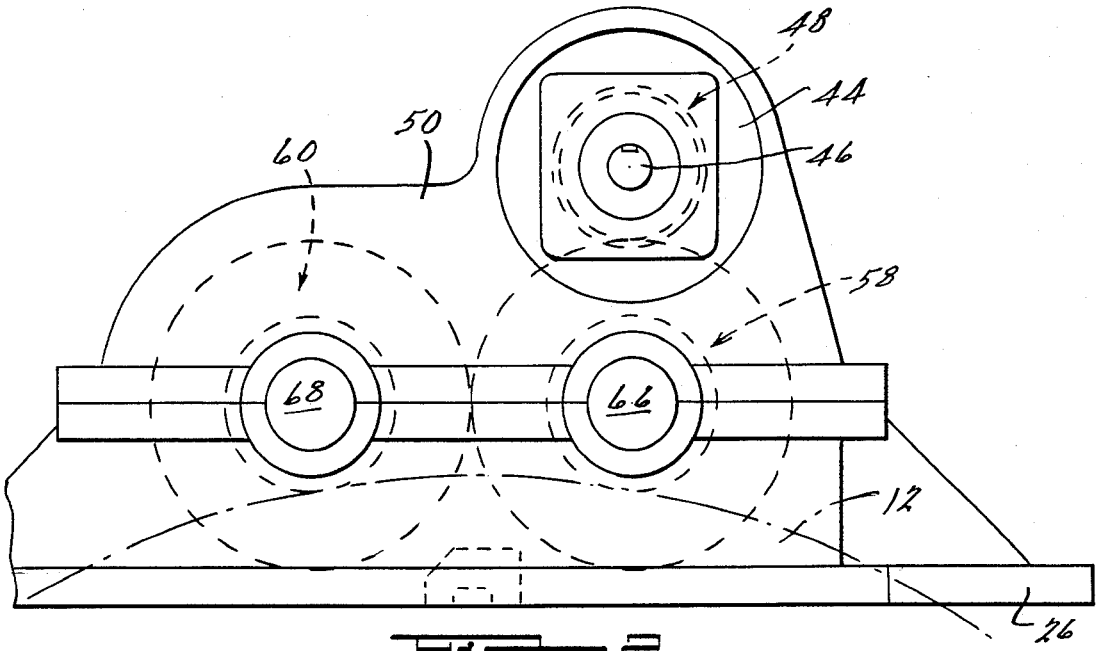
FIG. 2 is an enlarged elevated view of the drive unit of FIG. 1.
Figure 3:
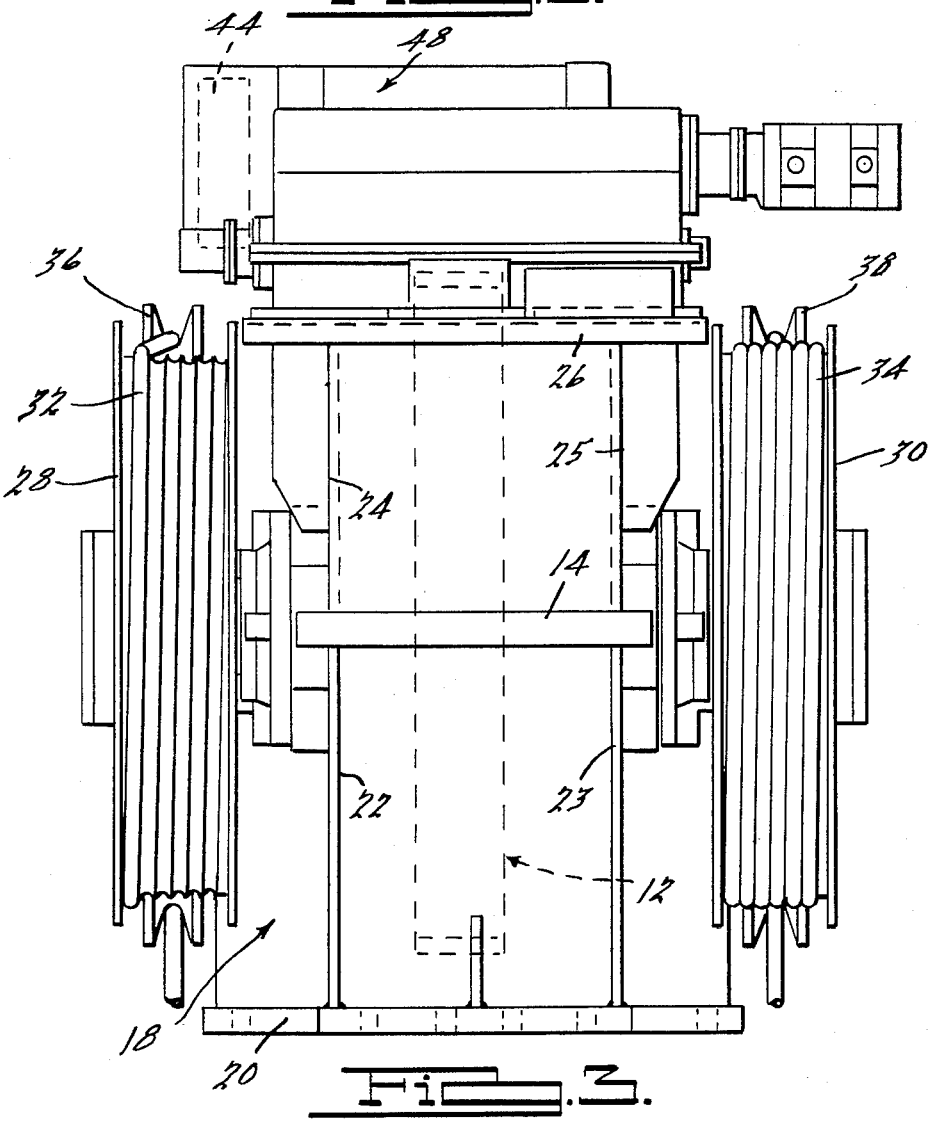
FIG. 3 is an elevated side view of the pump of FIG. 1.

Referring to FIG. 1, a pump assembly 10 is illustrated using a bull gear 12 rotatable on a shaft 14 and secured to the shaft 14 by suitable key (not shown). The shaft 14 is mounted in a housing 18, including a base member 20, referring to FIG. 3, lower shaft support members 22 and 23, upper shaft support members 24 and 25, and drive support member 26. The bull gear 12 rides on the shaft 14 within the housing 18 intermediate two drive pulleys 28 and 30 (FIG. 3) which are also operably mounted on the shaft 14 by suitable keys, such as key 31 (FIG. 1). Cables 32 and 34 are wrapped around the drive pulleys 28, 30. Cable 32 is wrapped around drive pulley 28 in the opposite direction to cable 34 wrapped around drive pulley 30. Drive pulley 28 will be referred to hereinafter as the raising pulley and drive pulley 30 will be referred to hereinafter as the lowering pulley (although the relationship of the pulleys is merely relative and can be selected or reversed as desired in the installation of the unit). A pair of idler pulleys 36 and 38 are mounted to the housing 18 on a rotational axis parallel to that of the drive pulleys 28, 30. In the described embodiment, the rotational axis of the idler pulleys is disposed along the intersection of a horizontal line which also intersects the rotational axis of the drive pulleys 28, 30. The cable from the raising pulley 28 comes from the top of the raising pulley 28 over the idler pulley 36 and down to the counterbalanced weights in a hole adjacent the pump assembly 10. The lowering pulley 30 has its cable directed upwardly from the bottom of the pulley 30 over the top of idler pulley 38 and downwardly into operable association with a sucker rod in the well hole. The operable association of the cables 32 and 34 with the sucker rod in the well hole and the weights in the counterbalance hole is done conventionally and need not be discussed in detail here. A motor 40 and motor control 41 are mounted onto the drive support member 26 of the housing 18. A belt 42 from the motor 40 is operably associated with a fly wheel pulley 44 mounted on a shaft 46 of a pump drive unit 48 also mounted on the drive support member 26.

Figure 4:
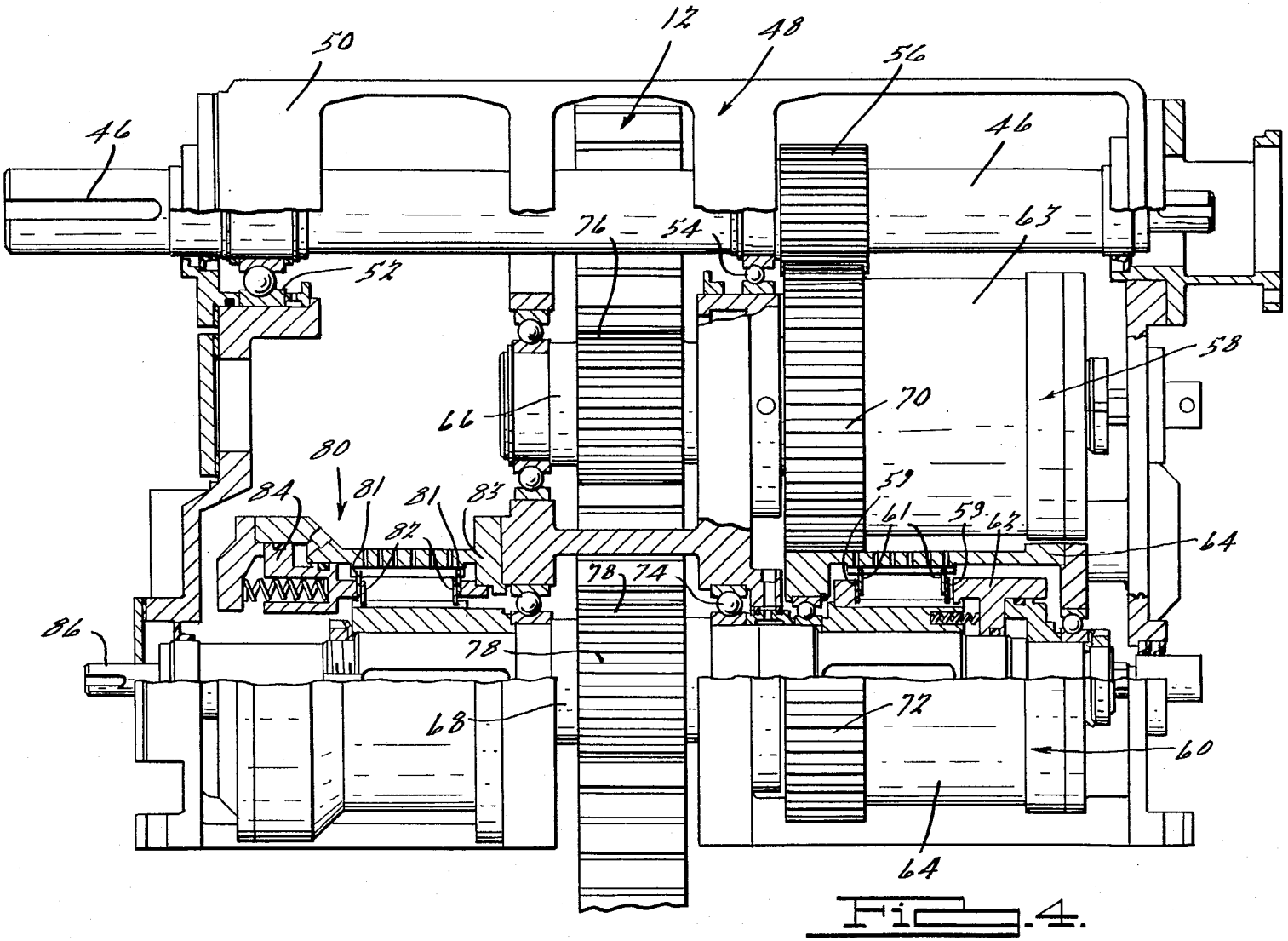
FIG. 4 is a horizontal sectional view of FIG. 1 along the lines 4—4.

Referring to FIG. 4, the input shaft 46 of the drive unit 48 is mounted in a housing 50, with suitable bearing assemblies 52 and 54. A pinion gear 56 is mounted on the shaft 46 at an intermediate location thereof. Two clutches, a raising clutch 58 and a lowering clutch 60 are mounted in parallel to the input shaft 46 and to one another within the housing 50. The clutches 58 and 60 comprise a series of discs 59 and plates 61 in a bath of oil similar to those oil shear clutches described by applicant's U.S. Pat. No. 3,696,898, actuatable by an externally controlled piston 62 into engagement and disengagement. The plates 61 are cooperably associated to move with the external housing 63 or 64 of the clutches 58 or 60, respectively. The discs 59 are splined to the moveable shafts 66 or 68 of the clutches 58 or 60, respectively. The piston 62 of each clutch forms a chamber 65 with an extended portion 67 of each shaft 66 or 68.

Reduction gears, 70 and 72 are fixedly secured to the housings 62 and 64 respectively, and intermesh with one another so that the gears are driven in opposite directions. The pinion gear 56 of the input shaft 46 meshes with the housing gear 70 of clutch 58 to drive the mechanism via gears 70 and 72. The housings 63 and 64 are rotatably mounted to the housing 50 by suitable bearing mechanisms 54 and 74. A pinion gear 76 is mounted on shaft 66 and a second pinion gear 78 is mounted on shaft 68 to operably mesh with the drive bull gear 12 of the pump assembly 10. Thus, when the plates and the discs of clutch 58 are operably engaged, the pinion gear 76 will rotate in one direction to drive the bull gear 12 to raise the sucker rod vertically in the well hole. Clutch 58 then is disengaged and clutch 60 is engaged to drive pinion gear 78, which in turn drives the bull gear 12 in the opposite direction to lower the sucker rod in the well hole.

A brake mechanism 80 is also mounted on the shaft 68 of the lowering clutch 60. The brake mechanism 80 also comprises a series of plates 81 and discs 82 with the plates 81 operably splined with a stationary external housing 83 and the discs 82 operably splined to the shaft 68, to be actuated by piston actuating means 84 into engagement and brake the assembly 10. The piston 84 moves in a chamber 85. One end 86 of the shaft 68 extends through the brake unit 80. The end 86 of the shaft 68 is used as a sensor to which a transducer 88 is attached to determine the stroke drive speed and position of the unit. The transducer 88 may be one of many types of conventional angular displacement and speed transducers on the market which attach to the end of a rotating shaft. The brake unit 80 has been attached to the shaft 68 of the lowering clutch 60 but may, if space considerations allow, be attached to shaft 68 of the raising clutch 58 just as readily and be within the scope of the present invention.

Figure 5:
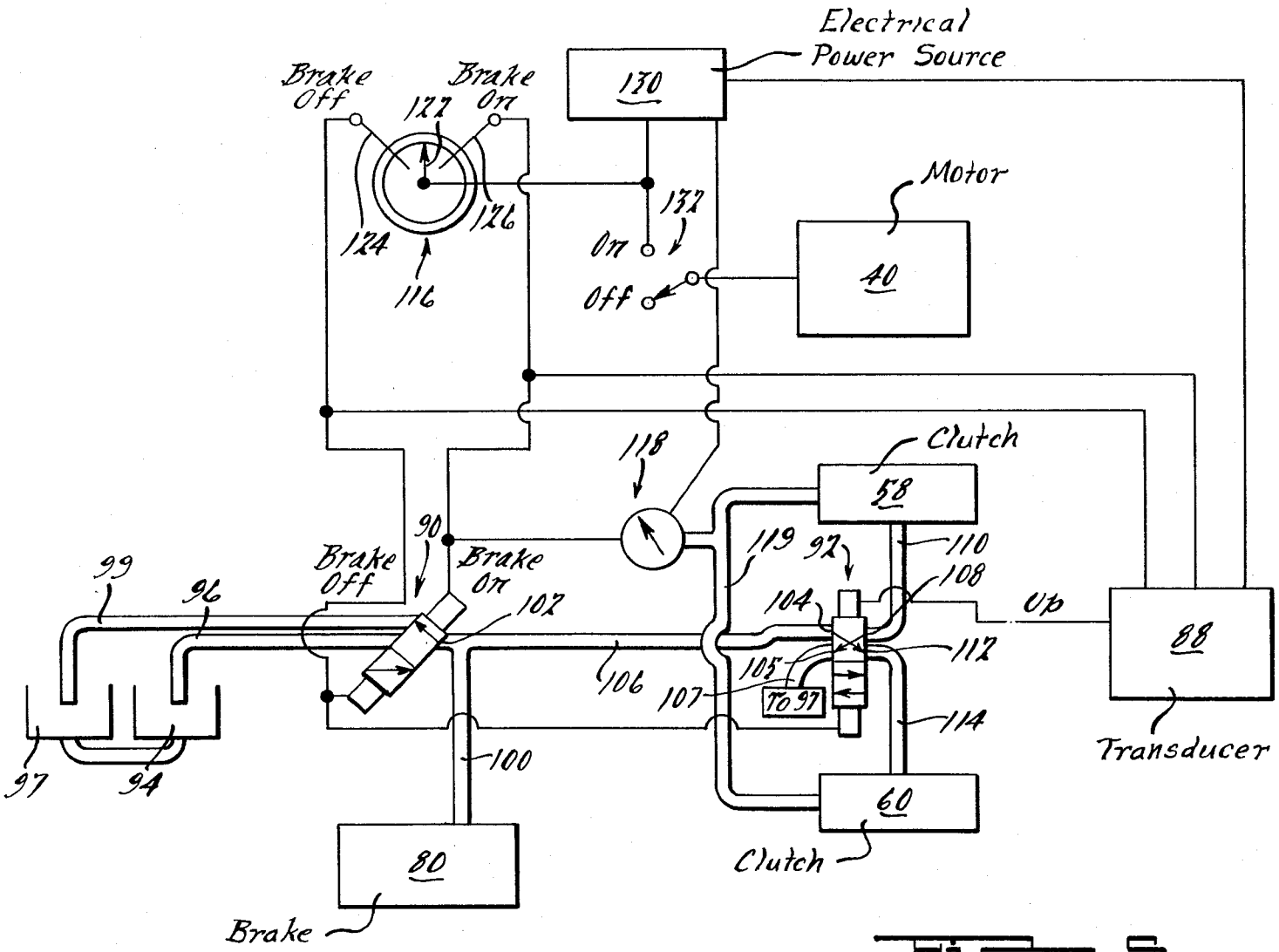
FIG. 5 is a schematic diagram of the apparatus of the present invention including the control system thereof.

Thus, referring to FIG. 5, the clutches 58 and 60 are alternately engaged and disengaged to provide the lowering and the raising of the sucker rod in the well hole via control of two two-way oil control valves 90 and 92 controlling the flow of oil from a pressurized oil reservoir or pumping source 94. The pressurized oil reservoir 94 communicates with the first valve via a conduit 96. In the "Brake Off" position, the first valve 90 communicates conduit 96 with conduit 106 which in turn communicates pressurized oil with one of the inlet ports 104 or 105 to the second valve 92 and with the piston chamber 85 of the brake 80 via conduit 100. The inlet port 104 or 105 other than the port communicating with conduit 106 will dump oil to a sump 97 via conduit 107. The first valve 90 has a second alternative in the "Brake On" position which communicates conduit 106 with conduit 99 to bleed to a sump 97 while also stopping the flow of pressurized oil out of conduit 96.

The second valve 92 has a pair of outlets 108 and 112 which communicate alternately with the piston chamber (not shown) of the raising clutch 58 via conduit 110 or with the piston chamber 65 of the lowering clutch 60 via conduit 114 and oil passage 115 (FIG. 4).

The valves 90 and 92 and the motor 40 are interconnected within a control mechanism receiving input signals from the position transducer 88, an adjustable contacts ammeter 116 (increasing in value in a counterclockwise direction as shown in FIG. 5), and an oil pressure sensor 118 to control the valves 90 and 92 that, in turn, control the brake 80 and clutches 58 and 60.

If the oil pressure sensor 118 indicates less than adequate oil pressure in the housings 63 or 64 of the clutches 58 and 60, the oil valve 90 will be positioned by signal from the sensor 118 to maintain the brake 80 actuated to prevent a runaway condition. Contact between the ammeter needle 122 and one of the adjustable contacts 124 or 126 of the ammeter 116 energizes the valve 98 in one direction or the other to send pressurized oil from the reservoir 94 to either the brake 80 or alternatively to one of the clutches 58 or 60. The electric motor 40 is preferably run continuously through the operation of the pump assembly 10.

The position transducer monitors the angular displacement of a selected shaft 86 and signals when a selected interval of displacement has been obtained by that shaft, at which point a signal is sent to the valve 90 to actuate the valve into a flow of oil to the brake 80 to actuate the brake 80. The ammeter needle 122 will move in response to the increased resistance to flow until the needle 122 contacts the "brake off" adjustable contact 124 at which point the valve 90 is signal pulsed into flowing oil to the "down" clutch 60 to commence lowering the sucker rod into the well hole and the transducer 88 is reset by a pulse signal to zero. Once movement begins, the transducer 88 starts to measure displacement. At the selected number of revolutions, a signal pulse is emitted from the transducer 88 to the clutch valve 92 to move the valve 92 to communicate oil to the "up" clutch 58 and commence lifting the sucker rod in the well hole. The transducer 88 moves in the opposite direction with its associated shaft until it reaches its original starting point at which time a signal is pulsed to the valve 90 to again actuate the brake 80, and recommence the cycle.

Suitable protective switches to guarantee one way flow, such as between the transducer 88 and "on" side of valve 90, are not shown in the schematic and are believed to be conventional. Any time the current falls or the cycle is initially starting its first stroke, the ammeter 116 will default to a brake "on" condition by contact between the needle 122 and the "on" contact 126. An electrical power source 130 energizes the control system, as shown in FIG. 5, as well as the electric motor 40 through a conventional on/off switch 132.

The brake 80 is engaged at the end of each stroke to provide a dwell setting to permit the sucker rod to catch up with the unit and permit its effective length to be used without any wasted length. The engagement and disengagement of the clutches 58 and 60 may be performed by an oil control mechanism with a ramp accelleration and deceleration of the clutch engagement, or as shown and described below, by a simple valve mechanism.

It must be noted that the denomination of the clutches as "raising" and "lowering" is relative. The clutches may be oppositely denominated if set up in a manner wherein the sucker rod is controlled by the opposite drive pulley.

It can be readily seen that the dwell time of the unit 10 may be readily altered to any selected dwell time based upon the amount of time that the brake 80 is engaged. Also the speed of the unit may be readily controlled by the automatic control that presents oil to the clutches 58 and 60 of the unit and the speed control of the drive motor 40. In the present construction, a forty to fifty foot stroke may be used. A four second dwell between reversals has been found to be sufficient to permit a ten foot sucker rod to catch up at each stroke reversal. This dwell, of course, may be changed over the lifetime operation of the well as the flow rate changes. It is believed, however, that only discrete changes will be necessary, with no need for automatic feedback controls nor for minute variance alterations of the dwell setting.

An adjustable production rate is also readily available from the above-described pump assembly 10, since the pump speed and dwell time are so easily controllable as desired without the complexities of a hydrostatic drive. A flow rate sampling and the motor amperage can be monitored by conventional means while the sucker rod travels upwardly and speed and dwell can be adjusted so that optimum conditions may be consistently maintained. The monitor means for the motor current on the upward portion of the pumping stroke is the ammeter 116. The distance between the contacts will then be the dwell time that the brake will operate and adjustment of the distance between the contacts may be a means of adjusting the amount of dwell time. As stated above, an oil sensor in the clutch housings 63 or 64 may also be used to maintain the brake in all operable unreleased positions until the oil pressure in the clutch is at a predetermined level in order to control against a falling runaway condition.

The monitoring of several of the units 10 of the present invention may also be performed at a single station or by a central computer. Plug-in monitors may also be readily implemented for monitoring individual units without interfering with or stopping the operation of the unit 10, since motor amperage, dwell time, and sampling can be performed on one unit without interfering with or stopping the operation of any other unit.

Thus, there is disclosed in the above description and the drawings an improved oil well pump drive unit which fully and effectively accomplishes is the objectives thereof. The dimensions and operating times set forth in the above specification are merely representative and are not meant to be limiting on the scope of the invention. It would be apparent tht variations and modifications of the disclosed embodiments may be made without departing from the principles of the invention or the scope of the appended claims.

I claim:

1. An oil well pump assembly including means for pumping oil from an oil well through a well hole comprising a pumping rod and means for reciprocating said pumping rod in said well hole, counterbalance means for reducing the power needed to pump said oil, motor means, means for driving said reciprocating means, and means for driving said counterbalance means, the improvement comprising:

means for engaging said motor means alternately with said reciprocating driving means and said counterbalance driving means comprising:

oil shear clutch means operably associated with said reciprocating driving means to raise said reciprocating means, and oil shear clutch means operably associated with said counterbalance driving means to raise said counterbalance means; and oil shear brake means operably associated with said engaging means for stopping both said reciprocating means and said counterbalance means in a selected position for a selected amount of stroke dwell time;

said reciprocating driving means comprising a rotatable element and a first cable operably associated with said rotatable element and said counterbalance means comprising a rotatable element and a second cable operably associated with said rotatable element.

2. A pump assembly in accordance with claim 1, wherein said engaging means further comprises gear means for interconnecting said driving means with each of said oil shear clutch means.

3. A pump assembly in accordance with claim 2, wherein each of said oil shear clutch means is operably associated with a drive shaft.

4. A pump assembly in accordance with claim 3, wherein said oil shear brake means is operably disposed on the drive shaft of one of said oil shear clutch means.

5. A pump assembly in accordance with claim 4, further comprising gear means for interconnecting said drive shafts of said clutch means with said reciprocating means and said counterbalance means.

6. A pump assembly in accordance with claim 5, wherein said gear means for interconnecting said drive shafts of said clutch means comprises a pinion gear on each of said drive shafts and a bull gear disposed in meshing engagement with both of said pinion gears and drivingly engaged to both said reciprocating means and said counterbalance means.

7. A pump assembly in accordance with claim 1, wherein said reciprocating means includes a cable, said pump assembly further comprising means for minimizing sideloads imposed on said pumping rod.

8. An oil well pump assembly including means for pumping oil from an oil well hole comprising a pumping rod and means for reciprocating said pumping rod in said hole, counterbalance means for reducing the power needed to pump said oil, and means for driving said reciprocating means and said counterbalance means, including electric motor means, the improvement comprising:

means for adjusting the production rate of said pump assembly comprising means for controlling the speed of said electric motor means; and means for dwelling said pump assembly a selected amount of time between reciprocations of said pumping rod by said reciprocating means comprising oil shear brake means operably associated with said driving means, means for detecting the end of a stroke operably associated with one of said reciprocating means or said counterbalance means, means for monitoring said motor current, including signal means, and means for engaging and disengaging said brake means in response to signals from said monitoring means;

said reciprocating driving means including a rotatable element and a first cable operably associated with said rotatable element and said counterbalance driving means including a rotatable element and a second cable operably associated with said rotatable element.

9. A pump assembly in accordance with claim 8, further comprising means for monitoring the flow rate of said oil pumping means, and said adjusting means includes means for controlling the speed of said motor in response to the output of said monitoring means.

10. A pump assembly in accordance with claim 9, further comprising means for adjusting the time of dwell provided by said dwelling means in response to the output of said monitoring means.

11. A pumping assembly in accordance with claim 8, further comprising means to control against all runaway of said pumping rod including means for sensing the oil pressure in said driving means and means for engaging said brake unit until a selected oil pressure is obtained.

12. A pumping assembly in accordance with claim 8, further comprising means for controlling the acceleration and deceleration of the pumping means as a ramp function.

* * * * *